US007971736B1

(12) United States Patent
Stewart

(10) Patent No.: US 7,971,736 B1
(45) Date of Patent: Jul. 5, 2011

(54) MAGNETIC KNIFE HOLDERS

(76) Inventor: John Michael Stewart, Plano, TX (US)

( * ) Notice: Subject to any disclaimer, the term of this patent is extended or adjusted under 35 U.S.C. 154(b) by 212 days.

(21) Appl. No.: 12/237,704

(22) Filed: Sep. 25, 2008

(51) Int. Cl.
*A47F 7/00* (2006.01)

(52) U.S. Cl. ..... 211/70.7; 248/37.3; 248/37.6

(58) Field of Classification Search ..... 248/206.5, 248/309.4, 37.3, 37.6, 542; 30/298.4; 211/DIG. 1, 211/70.7
See application file for complete search history.

(56) References Cited

U.S. PATENT DOCUMENTS

| | | | | |
|---|---|---|---|---|
| 2,955,239 | A | 10/1960 | Rouse | |
| 3,195,021 | A | 7/1965 | Martin | |
| 3,419,832 | A | 12/1968 | Baermann | |
| 3,827,021 | A | 7/1974 | Phelon | |
| 3,842,980 | A | 10/1974 | Kushner | |
| 4,183,439 | A | 1/1980 | Bell | |
| 4,451,810 | A | 5/1984 | Miller | |
| 4,497,412 | A | 2/1985 | Labelle | |
| 4,586,616 | A * | 5/1986 | Cooper et al. | 211/88.04 |
| 5,011,102 | A | 4/1991 | Kiefer | |
| 5,097,966 | A * | 3/1992 | Miller | 211/87.01 |
| D338,583 | S | 8/1993 | Esposito, Jr. | |
| 5,301,822 | A | 4/1994 | Coleman et al. | |
| 5,669,516 | A | 9/1997 | Horn | |
| 6,004,229 | A * | 12/1999 | Fazekas | 473/406 |
| 6,318,569 | B1 * | 11/2001 | Rothing | 211/90.01 |
| 6,575,313 | B1 | 6/2003 | Chen | |
| 6,626,303 | B1 * | 9/2003 | Moodie | 211/70.7 |
| 6,719,155 | B1 | 4/2004 | Chang | |
| 7,073,672 | B2 | 7/2006 | Sholem | |
| 7,172,079 | B1 | 2/2007 | Shiao | |
| 2002/0130231 | A1 | 9/2002 | Winnard | |
| 2002/0175131 | A1 * | 11/2002 | Johnson | 211/70.7 |
| 2010/0269400 | A1 * | 10/2010 | Gesik | 43/54.1 |

FOREIGN PATENT DOCUMENTS

| | | |
|---|---|---|
| GB | 2 389 031 | 12/2003 |

* cited by examiner

*Primary Examiner* — Gwendolyn Baxter
(74) *Attorney, Agent, or Firm* — Swift Law Office; Stephen Christopher Swift

(57) ABSTRACT

Magnetic holders for knives or similar objects, formed from boards that are sawed in half lengthwise, to form a front half and a rear half. A shallow wide hole is drilled in the center of the exterior surface of the front half, in which a disk having company logo or other design is inserted. On both sides of the center, evenly-spaced wide holes are drilled from the interior surface of the front half about half-way through, then narrow holes are drilled the rest of the way through from the centers of the wide holes. Coin-shaped magnets are placed in the wide holes, and dowels are placed in the narrow holes to mark the position of the magnets. Knives may be retained on the holder by the magnets at the positions marked by the dowels. The front and rear halves are then glued together, for a seamless look.

3 Claims, 13 Drawing Sheets

MAGNETIC KNIFE HOLDERS

BACKGROUND OF THE INVENTION

1. Field of the Invention

The present invention relates to magnetic holders for knives or similar objects.

2. Description of the Prior Art

There have been previous inventions of magnetic holders for knives or similar objects, but none that are equivalent to the present invention.

U.S. Pat. No. 4,183,439, issued on Jan. 15, 1980, to William W. Bell, discloses a utensil and tool holder, that retains knives (and other utensils or tools) on magnetic strips that hang from a bracket. The instant invention is distinguishable, in that it uses disk-shaped magnets that are enclosed in non-magnetic material.

U.S. Pat. No. 4,451,810, issued on May 29, 1984, to Merrill R. Miller, discloses a magnetic tool holder, having a pair of plates with a magnetic bar sandwiched between the plates. The instant invention is distinguishable, in that it uses several disk-shaped magnets, rather than a single bar.

U.S. Pat. No. 5,011,102, issued on Apr. 30, 1991, to Walter J. Kiefer, discloses a magnetic knife holder, having disk-shaped magnets covered top and bottom by a cowling having a curved entry to guide the knife to the magnets. The instant invention is distinguishable, in that in it the magnets are embedded in a wooden board, and the knives are retained on the surface of the board.

U.S. Pat. No. 5,301,822, issued on Apr. 12, 1994, to Edward S. Coleman and Richard Scalise, discloses a magnetic tool holder, having a single elongated magnet, rather than several disk-shaped magnets as in the instant invention.

U.S. Pat. No. 6,575,313, issued on Jun. 10, 2003, to Kung Cheng Chen, discloses a structure for firmly resting tools thereon, with a magnetic sheet, rather than several disk-shaped magnets as in the instant invention.

U.S. Pat. No. 6,626,303, issued on Sep. 30, 2003, to Peter Moodie, discloses a magnetic presentation and display board, with two pairs of magnets for retaining various articles, including in each magnet pair a magnet on the exterior surface of the board, and a magnet embedded in the board. The instant invention is distinguishable, in that it is an elongated board with a single magnet for holding each knife, with every magnet embedded in the board, and dowels to mark the location of the magnets.

U.S. Pat. No. 6,719,155, issued on Apr. 13, 2004, to Ching-Tsung Chang, discloses a magnetic tool rack made of plastic, in which rectangular magnets are embedded. The instant invention is distinguishable, in that it is a wooden board in which disk-shaped magnets are embedded, with dowels to mark the location of the magnets.

U.S. Pat. No. 7,073,672, issued on Jul. 11, 2006, to Steven Sholem, discloses a tool organizer system, having a flat sheet of magnetically attracted material, rather than a board with embedded magnets as in the instant invention.

U.S. Pat. No. 7,172,079, issued on Feb. 6, 2007, to Hsuan-Sen Shiao, discloses a magnet rack that can be easily removed from a magnetically attractive surface. The instant invention is distinguishable, in that it is a wooden board with disk-shaped embedded magnets.

U.S. Pat. No. Des. 338,583, issued on Aug. 24, 1993, to John Esposito, Jr., discloses a design for a magnetic toothbrush support assembly. The toothbrushes appear to be retained by a single magnet, rather than several disk-shaped magnets as in the instant invention.

U.S. Patent Application Publication No. 2002/0130231, published on Sep. 19, 2002, to Stanley D. Winnard, discloses a method and apparatus for securing non-ferrous objects, using magnetic plates, rather than disk-shaped magnets as in the instant invention.

U.S. Patent Application Publication No. 2002/0175131, published on Nov. 28, 2002, to Alan L. Johnson, discloses a magnetic cutlery rack, with a backboard and a series of horizontal stop ledgers. The instant invention is distinguishable, in that in it there is a single elongated board on which the knives are retained vertically, and the magnets are embedded in the board, with their positions indicated by dowels.

British Patent No. 2 389 031, published on Dec. 3, 2003, inventors Paul Prelstman, Caroline Casey and Chris Parker, discloses a magnetic knife holder, having a plurality of magnets spaced apart in locations inside and along the length of a holder. Knives can be retained vertically on the horizontal holder. The instant invention is distinguishable in that it is formed from an elongated piece of wood that is sawed apart, drilled, and glued back together, with the magnets retained in the drilled holes, and the position of the magnets indicated by dowels.

None of the above inventions and patents, taken either singly or in combination, is seen to describe the instant invention as claimed.

SUMMARY OF THE INVENTION

The present invention is of magnetic holders for knives or similar objects, formed from boards that are sawed in half lengthwise, to form a front half and a rear half. A shallow wide hole is drilled in the center of the exterior surface of the front half, in which a disk having a company logo or other design is inserted. On both sides of the center, evenly-spaced wide holes are drilled from the interior surface of the front half about half-way through, then narrow holes are drilled the rest of the way through from the centers of the wide holes. Coin-shaped magnets are placed in the wide holes, and dowels are placed in the narrow holes to mark the position of the magnets. Knives may be retained on the holder by the magnets at the positions marked by the dowels. Slots for mounting on wall hooks are drilled or carved in the back surface of the rear half. The front and rear halves are then glued together, for a seamless look. The edges of the boards are preferably rounded.

Accordingly, it is a principal object of the invention to provide a means for removably retaining knives in an area where they may be conveniently retrieved.

It is another object of the invention to provide a means for removably retaining other objects in an area where they may be conveniently retrieved.

It is a further object of the invention to provide a means for retaining knives in an upright position on a wall.

Still another object of the invention is to provide a means for retaining other objects in an upright position on a wall.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is boards with embedded magnets for holding knives or similar objects.

Figure 1:
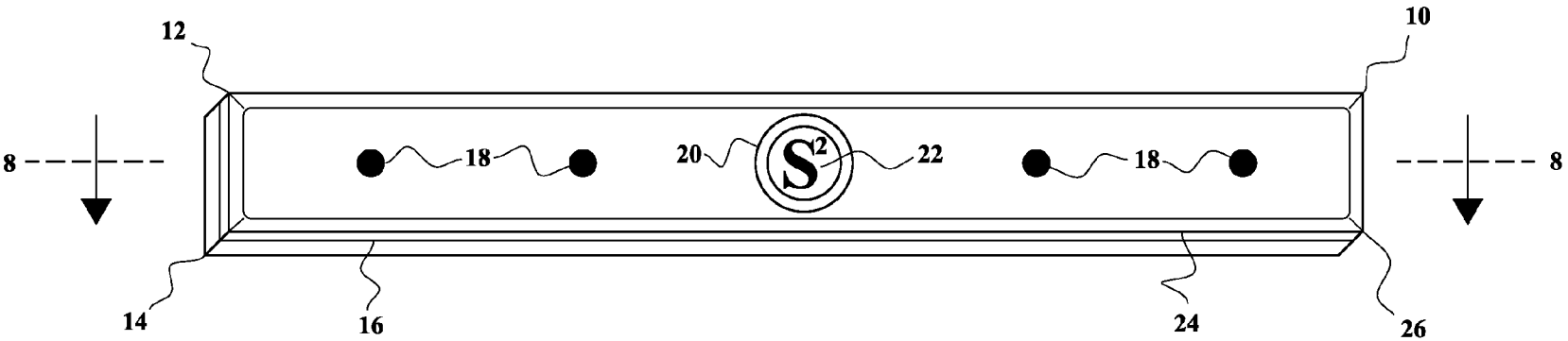
FIG. 1 is a perspective view of the first preferred embodiment of the invention.
Figure 2:
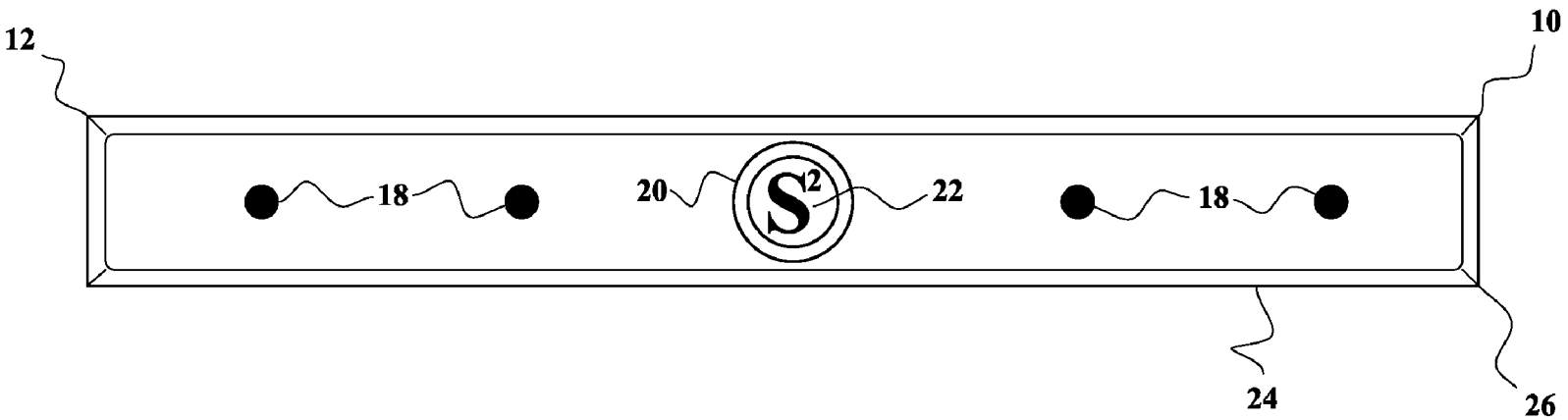
FIG. 2 is a front elevational view of the first preferred embodiment of the invention.

FIG. 1 is a perspective view of the first preferred embodiment of the invention, comprising a rectangular board 10, having a front half 12 and a rear half 14 retained together at glue joint 16, and holes (or "apertures") containing short segments of dowel rods 18 marking the location of magnets embedded in the board. (Alternatively, the apertures may be filled with any other suitable material having a different appearance from the exterior surface of the board.) A disk 20 (or "coin inlay") is retained in a shallow cylindrical hole in the center of the front surface of the board. There may be a company logo 22 or other decorative insignia on the exterior surface of the disk. The front edges 24 and front corners 26 of the front half of the board are preferably rounded. FIG. 2 is a front elevational view of the first preferred embodiment of the invention. The board is preferably made of hardwood, but it may made of any suitable material that is not attracted by magnets.

Figure 3:
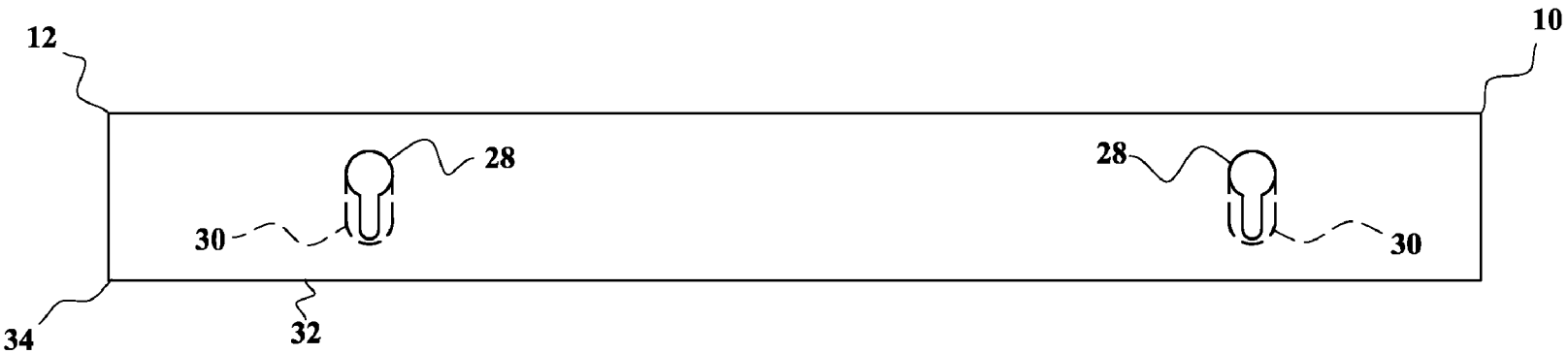
FIG. 3 is a rear elevational view of the first preferred embodiment of the invention.

FIG. 3 is a rear elevational view of the first preferred embodiment of the invention, showing the slots 28 with recesses 30 by which the board may be retained on a wall or other surface using screws, nails, hooks or similar objects. The rear edges 32 and rear corners of the rear half of the board are preferably left square.

Figure 4:
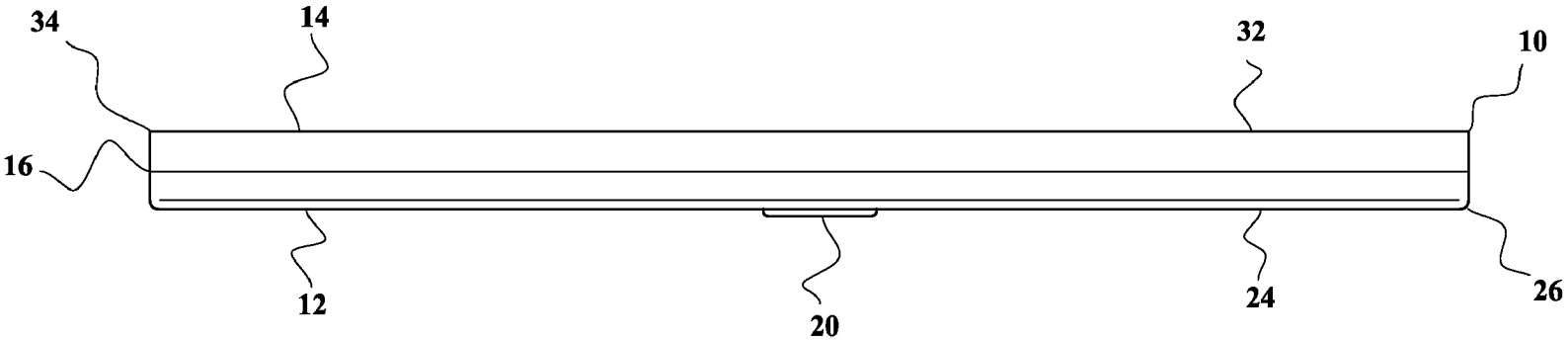
FIG. 4 is a top plan view of the first preferred embodiment of the invention, with the bottom view being identical.
Figure 5:
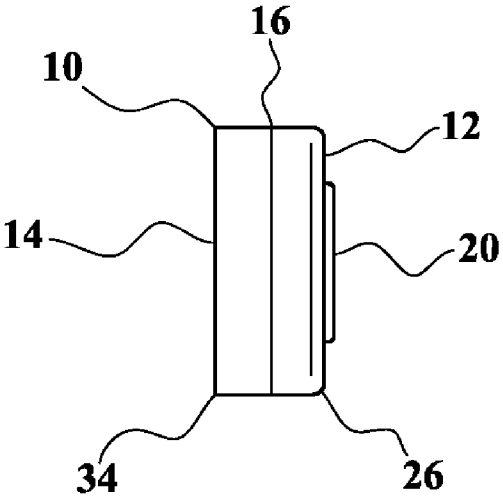
FIG. 5 is a left side elevational view of the first preferred embodiment of the invention, with the right side view being symmetrical.

FIG. 4 is a top plan view of the first preferred embodiment of the invention, with the bottom view being identical. The coin inlay 20 may extend slightly from the front surface of the board. FIG. 5 is a left side elevational view of the first preferred embodiment of the invention, with the right side view being symmetrical.

Figure 6:
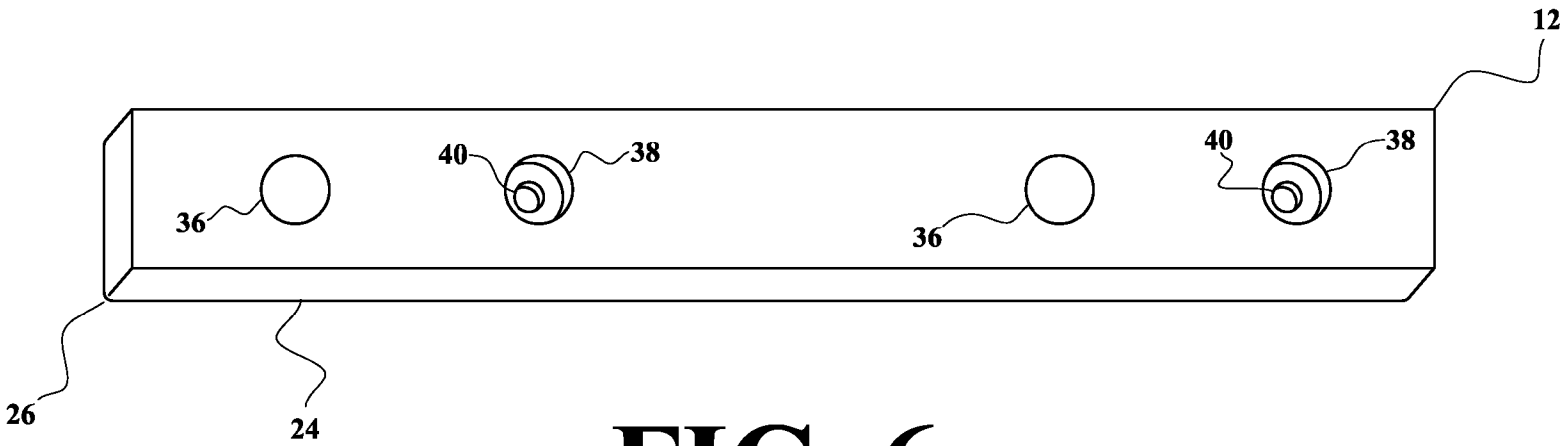
FIG. 6 is a rear perspective view of the front half of the first preferred embodiment of the invention, with the rear half removed.
Figure 7:
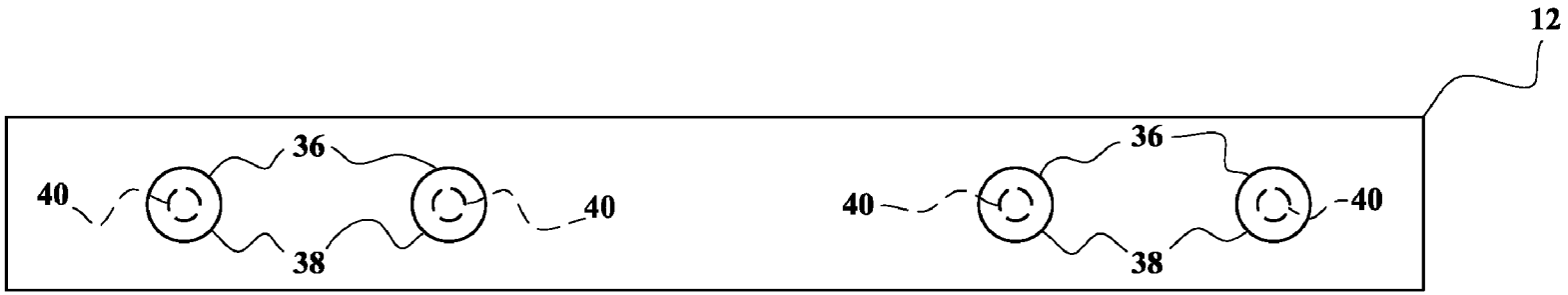
FIG. 7 is a rear elevational view of the front half of the first preferred embodiment of the invention, with the rear half removed.

FIG. 6 is a rear perspective view of the front half of the first preferred embodiment of the invention, with the rear half removed. For the sake of illustration, two disk-shaped magnets 36 are shown to fill two of the four disk-shaped cavities, while the other two disk-shaped cavities 38 are left empty. Small cylindrical apertures 40 pass between the center of each cavity and the front surface of the board, and are filled with the dowel rod segments that mark the location of the magnets. FIG. 7 is a rear elevational view of the front half of the first preferred embodiment of the invention, with the rear half removed, showing all the magnets 36 filling all the cavities 38, as they normally would. The exterior surfaces of the magnets should be flush against the interior surfaces of the cavities. The magnets are preferably made from a rare earth element such as neodymium, that can be intensely magnetized to strongly attract knife blades or other metallic objects to be removably retained on the board. The apertures 40 holding the dowel rod segments are shown in broken lines, as they are hidden from view by the magnets.

Figure 8:
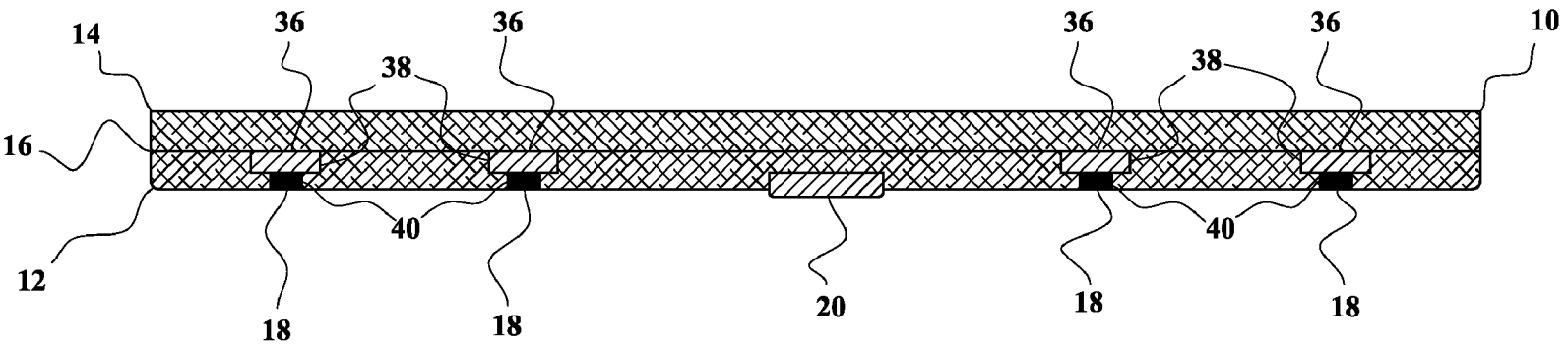
FIG. 8 is a section view of the first preferred embodiment of the invention along lines 8-8 of FIG. 1.

FIG. 8 is a section view of the first preferred embodiment of the invention along lines 8-8 of FIG. 1, taken halfway between the top and bottom surfaces of the board 10, and passing through the centers of: the coin inlay 20 and its recess, the magnets 36 and their recesses 38, and the dowel rod segments 18 and their apertures 40.

Figure 9:
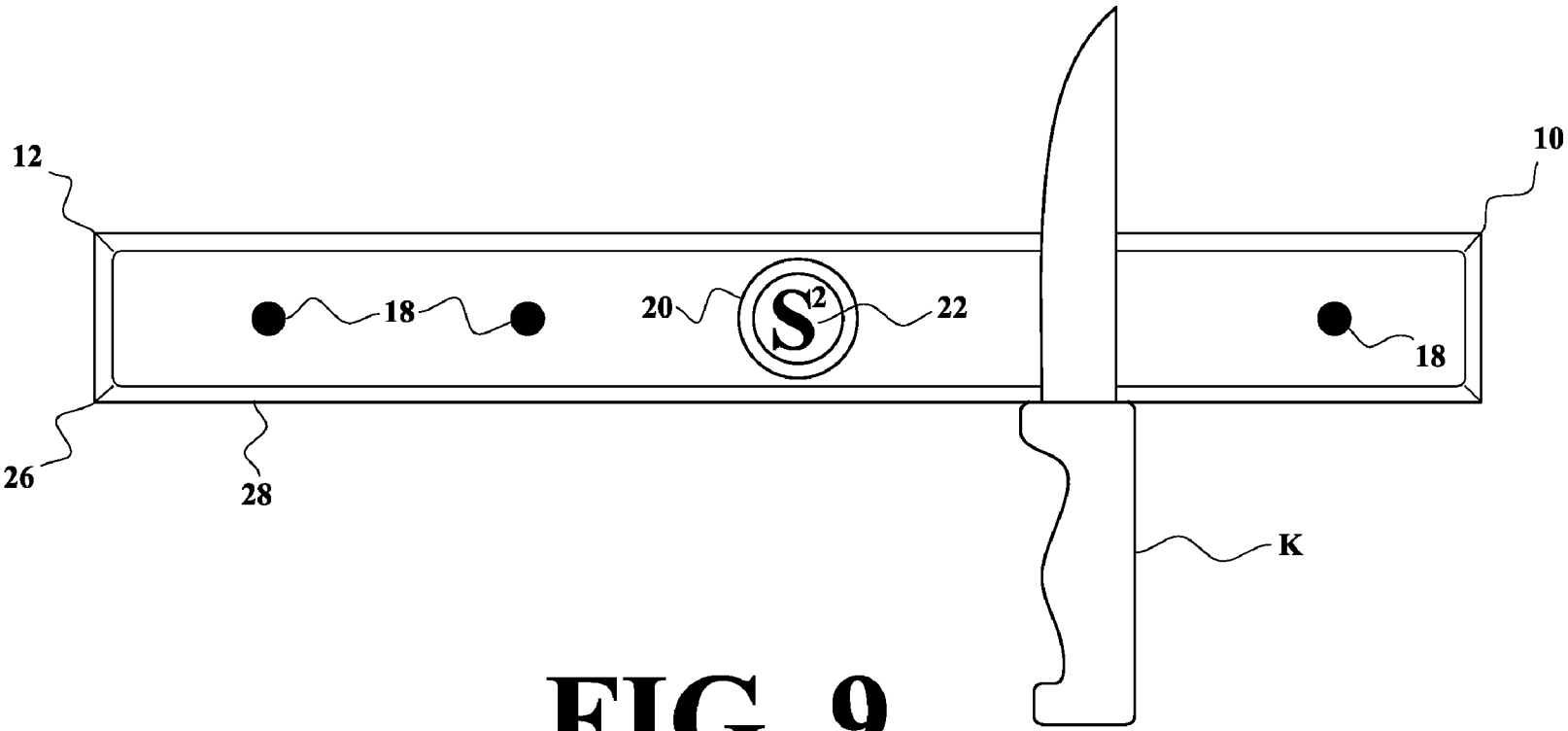
FIG. 9 is an environmental view of the first preferred embodiment of the invention, showing it holding a knife.

FIG. 9 is an environmental view of the first preferred embodiment of the invention, showing a knife K held on the board by the attraction of its metal blade by one of the hidden embedded magnets.

Figure 10:
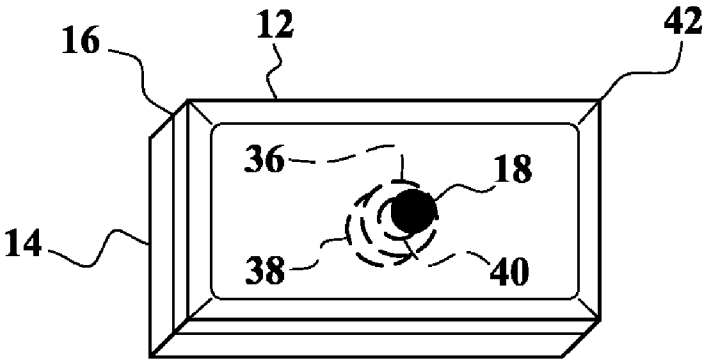
FIG. 10 is a perspective view of the second preferred embodiment of the invention.

FIG. 10 is a perspective view of the second preferred embodiment of the invention 42, which is the same as the first preferred embodiment, except that it has only a single magnet 36 in a single cavity 38, whose position is marked by a single dowel rod segment 18 in a single aperture 40, and has no coin inlay. (The magnet, cavity and aperture are shown in broken lines, as they are hidden from view.) It may be called a "SideCar", as it can be placed to the side of one of the longer boards to hold a single large knife or utensil.

The invention may be sold as set of magnetic knife holders, rather than individual holders sold separately. For the third, fourth and fifth preferred embodiments, for all the finished boards, the preferred width (distance from top edge to bottom edge) is two inches, and the preferred thickness (distance from front side to back side) is one inch. For the third, fourth and fifth preferred embodiments, all the magnets are preferably neodymium disks with a thickness of three-eighths of an inch.

Figure 11:
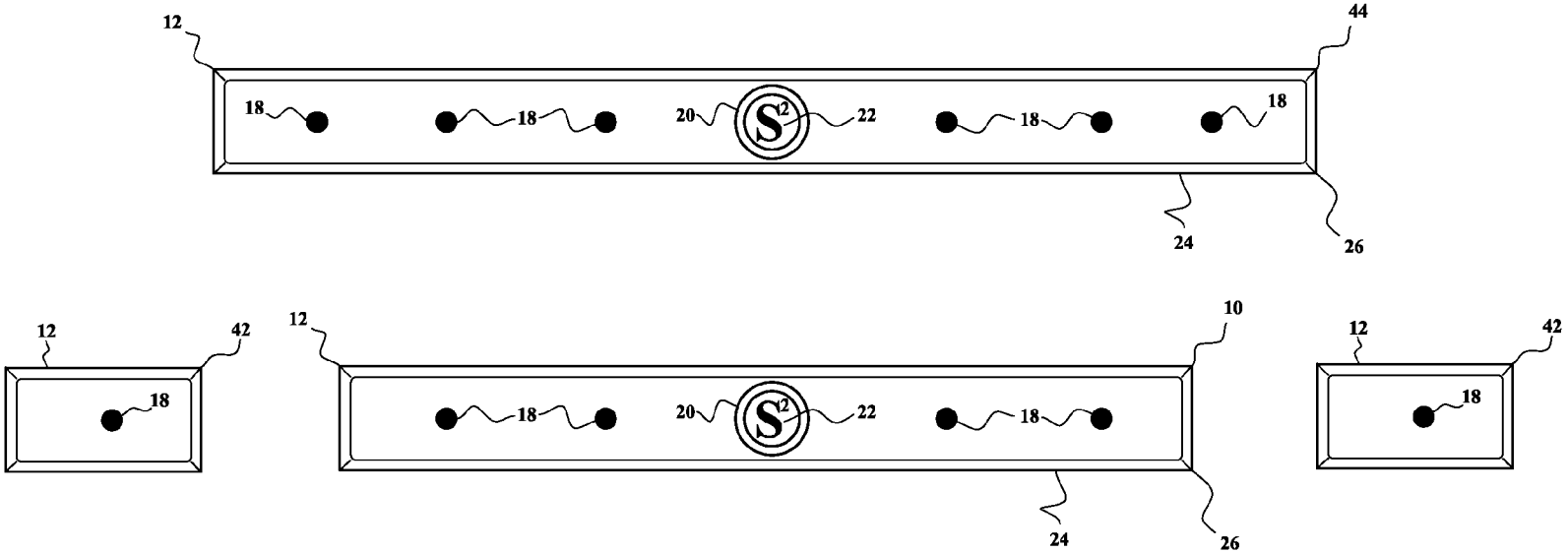
FIG. 11 is a front elevational view of the third preferred embodiment of the invention.

FIG. 11 is a front elevational view of the third preferred embodiment of the invention, which is a set of knife holders called the "Signature Series", having one six magnet board 44 (21 inches long), one four magnet board 10 (15 inches long), and two SideCars 42 (three inches long) with single magnets. The embedded magnets are preferably seven-eighths to one inch in diameter, with their centers spaced three inches from the centers of nearest magnets and/or the coin inlay.

Figure 12:
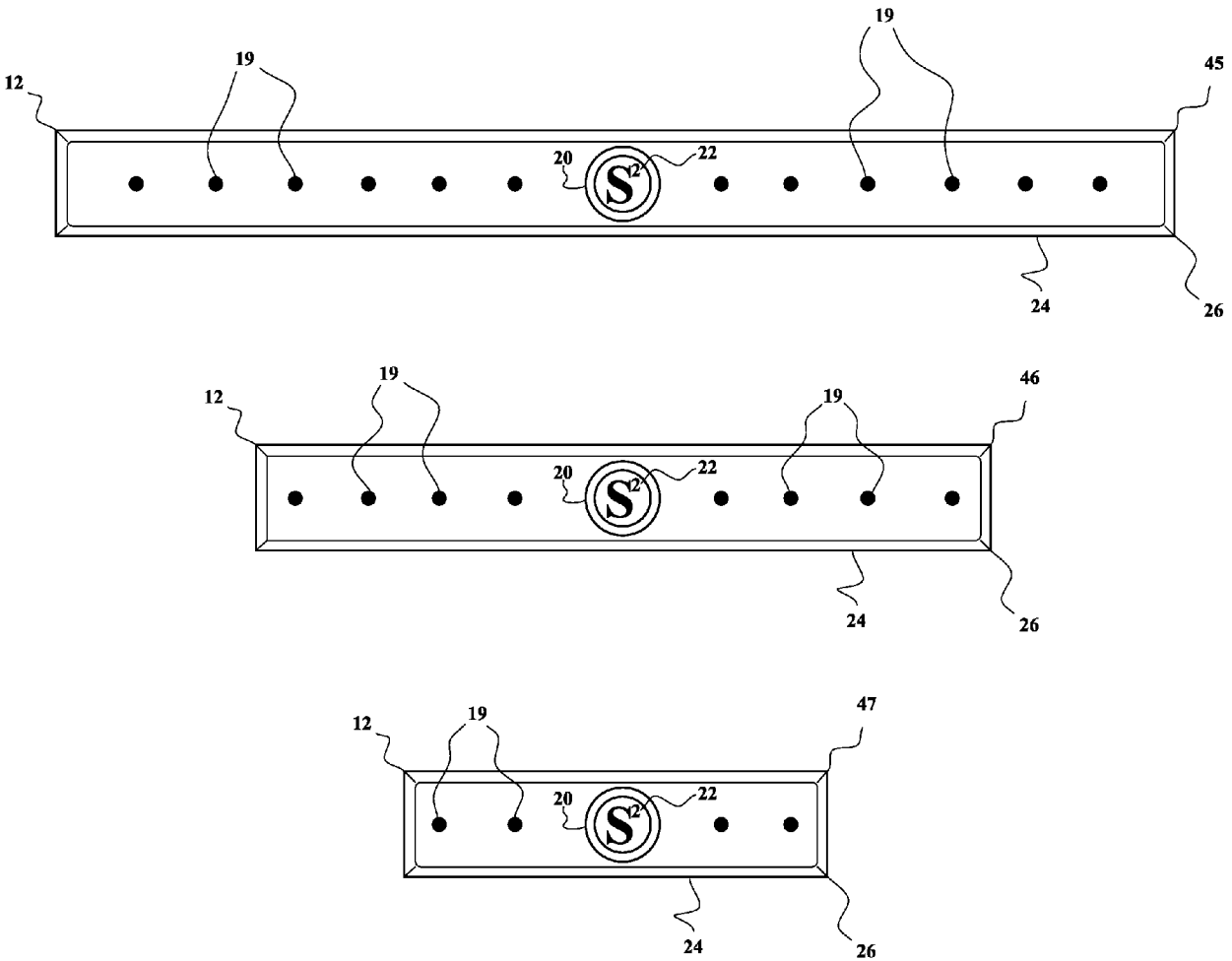
FIG. 12 is a front elevational view of the fourth preferred embodiment of the invention.

FIG. 12 is a front elevational view of the fourth preferred embodiment of the invention, which is a set of knife holders called the "Steak Knife Series", with one twelve magnet board 45 (19.5 inches long), one eight magnet board 46 (13.5 inches long), and one four magnet board 47 (7.5 inches long). The embedded magnets are preferably three-quarter of an inch in diameter, with their centers spaced one and a half inches from the centers of nearest magnets and/or the coin inlay, and their positions are indicated by smaller dowel plug 19, that are one-quarter inch in diameter.

Figure 13:
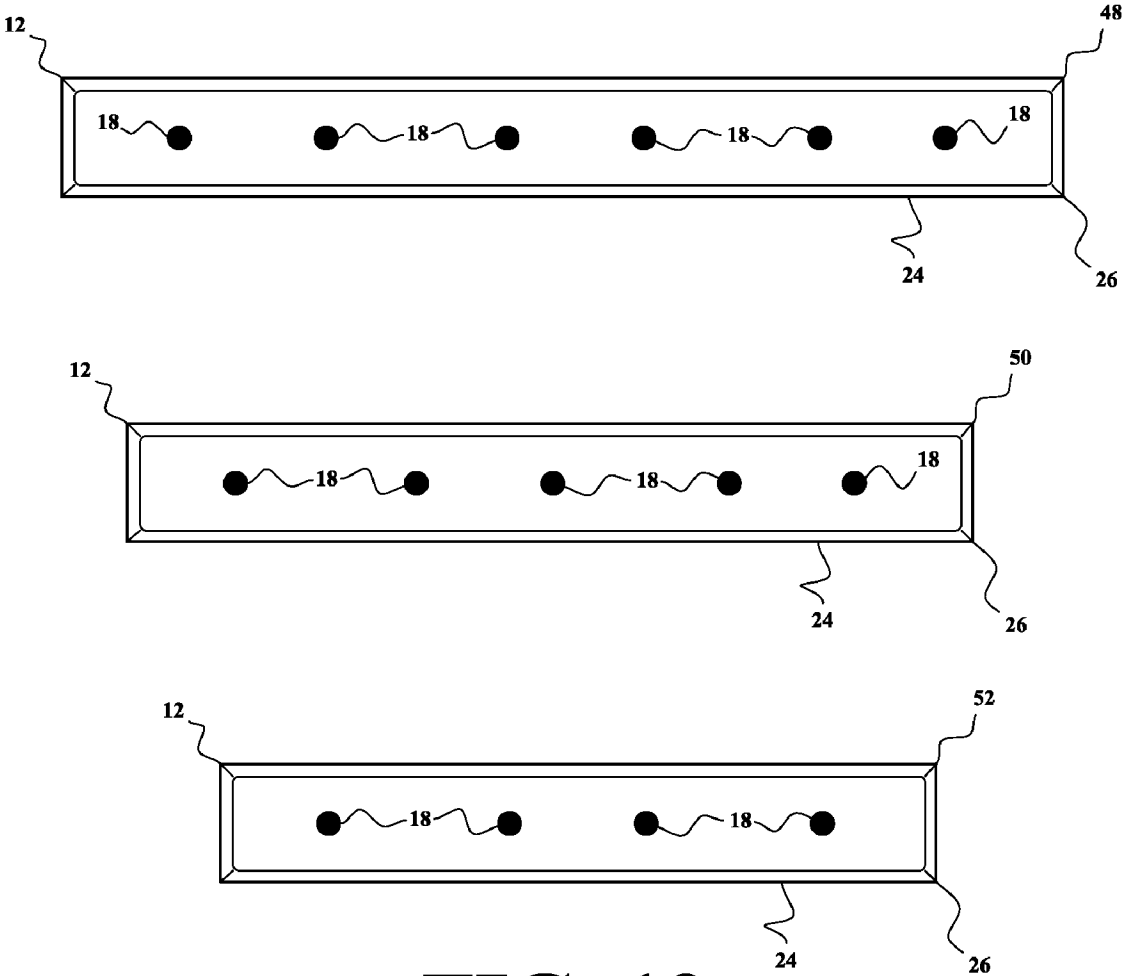
FIG. 13 is a front elevational view of the fifth preferred embodiment of the invention.

FIG. 13 is a front elevational view of the fifth preferred embodiment of the invention, which is a set of knife holders called the "Standard Series", comprising three boards with no coin inlays, including one six magnet board 48 (18 inches long), one five magnet board 50 (15 inches long), and one four magnet board 52 (12 inches long). The embedded magnets are preferably seven-eighths to one inch in diameter, with their centers spaced three inches from the centers of nearest magnets.

The preferred embodiments of the present invention may be constructed by a method including the steps of:

1. Obtaining a rectangular board (preferably 5/4 to 6/4 inches thick).

2. Cutting the board into a first piece and a second piece (each about ⅝ inches thick), with a cut that is parallel to two opposite surfaces of the board, yielding pieces that are a "closed" book-match, said match being maintained throughout the following steps.

3. Planing the first and second pieces to one-half inch of thickness.

4. Rip sawing the first and second pieces to two inches in width.

5. Cutting the first and second pieces to the desired length of the finished board.

6. Drilling pocket holes (or "cylindrical recesses") for the magnets in the interior surface of the first piece, said holes having the same diameter as the magnets and being ⅜ inch deep.

7. Drilling holes (or "cylindrical apertures") for dowel plugs between the cylindrical recesses in the interior surface of the first piece and the exterior surface of the first piece opposite to the interior surface, with the cylindrical recesses and cylindrical apertures being concentric, and the cylindrical apertures being one-quarter inch in diameter for the Steak Knife Series, and three-eighths inches in diameter for the Signature and Standard Series mentioned above.

8. Drilling a pocket hole for the center inlay coin in the exterior surface of the first piece, one and a half inches in diameter and the depth of the inlay coin.

9. Inserting one disk-shaped magnet into each of the cylindrical recesses.

10. Reattaching the second piece over the interior surface of the first piece, preferably with glue. The glue joint should be barely visible, because the first and second pieces are a "closed" book-match, that is maintained throughout the process.

11. Cutting a hardwood (e.g., maple or walnut) dowel (one-quarter to three-eighths inches in diameter) into plugs 3/16 inches long. The wood should be chosen to contrast with the surface of the board.

12. Putting glue on the dowel plugs and pressing them into the circular apertures, then allowing the glue to set. (Alternatively, filling the apertures with any suitable material having a different appearance from the board.)

13. Rough sanding of all surfaces of the invention to remove excess glue and make the surfaces flush with each other.

14. Rounding the edges and corners of the board on the front side of the first piece (preferably using one-quarter inch round-over).

15. Forming one or more recesses (or "mounting slots") in an exterior surface of the second piece of the board, suitably configured to enable the board to be retained (preferably by routing with a slot cutting bit).

16. Finish sanding of all surfaces, using progressive grits to obtain a desired smoothness.

17. Applying final finish, using two or three coats of edible mineral oil, edible walnut oil or edible shellac (They should be edible because the knives being held will contact the finish and then food and/or the holder could be chewed by children.)

18. Gluing and inserting the center inlay coin (having a diameter of one and a half inches) into its pocket hole.

The foregoing steps need not be performed in the exact order given. The dimensions given are for the sake of illustration only, and are not meant to limit the scope of the invention.

The design ensures that no contact between the magnet and knife (or other implement being held) can occur, because there is always about one-eighth inch of wood between the magnet and the knife. As the dowel plug has a color that contrasts with the board, it helps users locate the position of the magnets. The process of construction is basically the same for all sizes and types of knife holders. The size and number of magnets used can vary with the size and type of knives being held. Spacing varies with magnet size and the presence or absence of the decorative center inlay disk. The center inlay can have any desired insignia or design on its exterior surface. It is expected that the boards will primarily be constructed of domestic hardwood, but nearly any species of wood can be used, as can other material such as plastic, fiberglass, ceramics, etc. The overall dimensions of the holders and the size of the magnets can be varied to accommodate holding nearly any size or shape of implement.

It is to be understood that the present invention is not limited to the embodiments described above, but encompasses any and all embodiments within the scope of the following claims.

I claim:

1. A magnetic holder comprising:

a board made of material not attracted by magnets, said board being formed from two pieces that are attached together, including a first piece having an interior surface with a plurality of cylindrical recesses, and a second piece having an interior surface that covers the cylindrical recesses in the interior surface of the first piece, forming cavities that are entirely within the interior of the board; and a plurality of disk-shaped magnets retained within the cavities, said magnets not having contact with any exterior surface of the board, and said magnets being separated by a distance from any surface of the board against which a metallic article may be retained by magnetic attraction of said magnets;

wherein there are apertures between the disk-shaped cavities and an exterior surface of the board, that are filled with a nonmagnetic material having a different appearance from the board, marking the positions of the magnets within the interior of the board.

2. A magnetic holder comprising:

a board made of material not attracted by magnets, said board being formed from two pieces that are attached together, including a first piece having an interior surface with a single cylindrical recess, and a second piece having an interior surface that covers the cylindrical recess in the interior surface of the first piece, forming a cavity that is entirely within the interior of the board; and a disk-shaped magnet retained within the cavity, said magnet not having contact with any exterior surface of the board, and said magnet being separated by a distance from any surface of the board against which a metallic article may be retained by magnetic attraction of said magnet;

wherein there is an aperture between the disk-shaped cavity and an exterior surface of the board, that is filled with a nonmagnetic material having a different appearance from the board, marking the position of the magnet within the interior of the board.

3. A method of constructing a magnetic holder, comprising the steps of:

obtaining a rectangular board;

cutting the board into a first piece and a second piece, with a cut that is parallel to two opposite surfaces of the board;

forming one or more cylindrical recesses in a first surface of the first piece;

inserting disk-shaped magnets into the cylindrical recesses;

reattaching the second piece over the first surface of the first piece, enclosing the magnets entirely within the interior of the rectangular board with said magnets being separated by a distance from any surface of the board against which a metallic article may be retained by magnetic attraction of said magnets;

forming one or more apertures between the cylindrical recesses in the first surface of the first piece and a second surface of the first piece that is opposite to the first surface; and filling the apertures with a nonmagnetic material having a different appearance from the board, marking the positions of the magnets within the interior of the board.

* * * * *